US006474576B1

(12) United States Patent
Oota et al.

(10) Patent No.: US 6,474,576 B1
(45) Date of Patent: Nov. 5, 2002

(54) MILLING APPARATUS AND MILLING METHOD

(75) Inventors: Akiyasu Oota, Sanda (JP); Akihito Tsujimoto, Wakayama (JP); Katsumi Okayama, Kusatsu (JP)

(73) Assignee: Sumitomo Special Metals Co., Ltd., Osaka (JP)

( * ) Notice: Subject to any disclaimer, the term of this patent is extended or adjusted under 35 U.S.C. 154(b) by 0 days.

(21) Appl. No.: 09/522,472

(22) Filed: Mar. 9, 2000

(30) Foreign Application Priority Data

Mar. 10, 1999 (JP) ..... 11-62848

(51) Int. Cl.[7] ..... B02C 19/12
(52) U.S. Cl. ..... 241/34; 241/30; 241/100
(58) Field of Search ..... 241/30, 34, 100

(56) References Cited

U.S. PATENT DOCUMENTS

| | | | | | |
|---|---|---|---|---|---|
| 5,035,294 | A | * | 7/1991 | Volk Jr. | 177/70 |
| 5,522,556 | A | * | 6/1996 | Knepler et al. | 241/34 |
| 5,624,079 | A | * | 4/1997 | Higuchi et al. | 241/39 |
| 5,992,773 | A | * | 11/1999 | Schwechten | 241/5 |
| 6,082,640 | A | * | 7/2000 | Edlinger | 241/1 |
| 6,196,479 | B1 | * | 3/2001 | Edlinger | 241/1 |

FOREIGN PATENT DOCUMENTS

| | | |
|---|---|---|
| JP | 2-5872 | 2/1990 |
| JP | 2904403 | 3/1999 |

* cited by examiner

*Primary Examiner*—William Hong
(74) *Attorney, Agent, or Firm*—Armstrong, Westerman & Hattori, LLP.

(57) ABSTRACT

A milling apparatus comprises a mill for milling of an object material such as a rare-earth alloy. The mill includes a mill main body. A classifying rotor for classification of a powder is provided inside and at an upper portion of the mill main body. The mill main body has an outer circumference provided with three leg portions spaced equally from each other. Each of the leg portions supports the mill main body at a position above the center of gravity of the mill. Each of the leg portions is provided with a weight detector for detection of a weight of the mill holding the object material remaining in the mill. A flexible pipe is provided between the mill and a raw material feeder for supply of the object material to the mill. Another flexible pipe is provided between the mill and a collecting tank for collection of the powder. A controlling portion controls an amount of supply of the object material to the mill by a proportional-plus-integral-plus-derivative control based on a result of the detection by the weight detectors, for maintenance of a constant amount of the object material present in the mill.

7 Claims, 10 Drawing Sheets

MILLING APPARATUS AND MILLING METHOD

BACKGROUND OF THE INVENTION

1. Field of the Invention

The present invention relates to a milling apparatus and a milling method wherein an object material is milled by colliding the object material against each other within a mill. The present invention also relates to a sintered body manufactured from a powder obtained by the above milling method.

2. Description of the Related Art

A conventional milling apparatus of the above kind comprises a mill for milling of the object material, a raw material feeder for supply of the object material to the mill, and a collecting tank for collection of a powder obtained by the mill. The mill includes a nozzle for injection of a high-velocity blast of an inert gas, and a classifying rotor for classified collection of the milled powder.

In the mill, the object material fed by the raw material feeder are collided against each other into small grains by the high-velocity blast of the inert gas injected from the nozzle. The milled powder is taken out by the classifying rotor and then collected in the collecting tank.

During the above-described operation, in order to obtain a uniform grain size distribution in the powder collected in the collecting tank, a constant milling condition, i.e. a constant condition for the collision in the mill, must be maintained. Then, in order to maintain the constant milling condition, the amount of the object material present in the mill must be maintained at a constant level.

Conventionally, in order to maintain the amount of the object material present in the mill at a constant level, the amount of the object material fed by the raw material feeder is varied by detecting weight change of the collecting tank.

Another method is to detect a load current to an electric motor which drives the classifying rotor. This detection method uses a principle that the load to the electric motor is increased by an increased amount of the object material colliding against the classifying rotor when there is an increase in the amount of the object material in circulation within the mill. Thus, the amount of the object material fed by the raw material feeder is reduced when the load to the electric motor becomes not smaller than a predetermined value.

Still another method of control is to provide a sensor for detecting a level of the raw material in the mill in order to determine if the amount of the object material in the mill has reached a predetermined level. In this method the feed of the object material from the raw material feeder must be continued unless the predetermined level is detected.

However, according to these conventional methods, it is difficult to maintain the amount of the object material remaining in the mill at a constant level.

Specifically, according to the method of detecting the weight of the collecting tank, the amount of the object material actually remaining in the mill can only be detected with a certain time lag. Therefore, since a decrease in the amount of the object material from a predetermined level cannot be detected soon, there is always a delay in supply timing of the object material. Furthermore, the object material is always overfed even if there is already enough amount of the object material supplied.

On the other hand, according to the method of detecting the load current to the electric motor which drives the classifying rotor, although there is less problem of the time lag than in the method of detecting the weight of the collecting tank, it is impossible to make detection that allows precise measurement of a change in the amount of the object material.

According to the method of providing the raw-material level sensor in the mill, it is possible to determine if the amount of the object material has reached the predetermined level, without the time lag. However, it is impossible to determine how much of the object material should be added when the level has not yet reached to the predetermined level. Therefore, there is a possibility that the amount of feed of the object material is being increased gradually in an attempt to achieve the predetermined level, yet actually the mill is discharging a greater amount, further reducing the amount of the object material present in the mill from the predetermined amount. If a large amount of the object material is fed at one time in an attempt to eliminate such a possibility as above, the amount in the mill can easily go far beyond the predetermined level. Further, the level sensor can not detect the level of the object material accurately, since the object material is blown up in the mill.

SUMMARY OF THE INVENTION

It is therefore a primary object of the present invention to provide a milling apparatus and a milling method capable of obtaining a powder having a desired grain size distribution, by maintaining the amount of the object material in the mill at a constant level, and to provide a compact and a sintered body manufactured from the powder obtained by this milling method.

According to an aspect of the present invention, there is provided a milling apparatus comprising; a mill for milling of an object material, a raw material feeder for supply of the object material to the mill, a collecting tank for collection of a powder obtained by the mill, a weight detector for detection of a weight of the mill holding the object material remaining therein, and a controlling portion for control of an amount of supply of the object material to the mill based on an output from the weight detector, for maintenance of a constant amount of the object material present in the mill.

According to another aspect of the present invention, there is provided a milling method using a mill milling a supplied object material and discharging an obtained powder out of the mill, comprising; a first step of detecting a weight of the mill holding the object material remaining therein, and a second step of controlling an amount of supply of the object material to the mill based on a result of the detection in the first step, for maintenance of a constant amount of the object material present in the mill.

According to the present invention, the weight of the object material remaining in the mill is detected by detecting the weight of the mill holding the remaining object material. Thus, change in the weight of the object material remaining in the mill can be detected without time delay. Therefore, according to the present invention, as compared to a method, for example, of measuring the weight of the collecting tank which collects the powder discharged from the mill, the amount of feed of the object material into the mill can be varied more appropriately without time delay. As a result, it becomes possible to eliminate hunting caused by overfeeding, and maintain the amount of the object material in the mill at a constant level. Further, by detecting the weight, the weight deviation from a target value can be detected. Therefore, the amount of supply can be varied in accordance with the deviation, making possible to bring the amount of the object material in the mill close to the desired amount more quickly. As a result, the powder having a uniform grain size distribution can be obtained.

It should be noted here that in the present specification the term the "object material remaining in the mill" means the object material sedimented in the mill.

According to the present invention, preferably, the controlling portion controls the amount of supply of the object material by a proportional-plus-integral-plus-derivative control. By controlling the amount of supply of the object material by the proportional-plus-integral-plus-derivative control as above, the amount of the object material in the mill can be brought closer to the desired value, making possible to reduce fluctuation. Therefore, the grain diameter of the powder can be maintained within a constant range.

Further, preferably, the weight detector includes a plurality of detecting devices. By detecting the weight of the mill using the plurality of the detecting devices, it becomes possible to accurately detect the weight of the mill even if the mill is tilted or if the weight distributes unevenly to the detecting devices. Therefore, the object material can be supplied accurately relying on the detecting devices provided in each of the supporting portions.

Further, preferably, the mill includes a mill main body, and three supporting portions provided at an equidistant interval on a circumference of the mill main body, and further, each of the supporting portions is provided with the detecting device. By supporting the mill with three equidistant supporting portions as above, the mill can be supported stably without chattering. Therefore, the weight of the mill can be detected more accurately by the detecting device provided in each of the supporting portions.

Preferably, the mill includes the mill main body and the supporting portion for support of the mill main body at a position above the center of gravity of the mill. In this case, the mill can be prevented from tilting, and the weight of the mill can be detected accurately.

Further, preferably, the mill further includes a classifying rotor provided inside and at an upper portion of the mill main body for classification of the powder. If the classifying rotor is provided inside and at the upper portion of the mill main body, the center of gravity of the mill becomes higher, and the mill becomes more apt to tilt. Even with such a classifying rotor as this, by supporting the mill main body at a position above the center of gravity of the mill, the mill can be prevented from tilting, and the weight of the mill can be detected accurately.

Further, preferably, the milling apparatus further comprises a flexible pipe provided between the raw material feeder and the mill, and another flexible pipe provided between the mill and the collecting tank. By interposing the flexible pipes as described above, the weight of the object material remaining in the mill can be detected accurately without being affected by an amount of the object material in the raw material feeder or change in the amount of the powder in the collecting tank.

According to the present invention, preferably, a value corresponding to a weight of the object material remaining in the mill during the milling is set, a deviation is calculated based on an output from the weight detector and said value, and the amount of supply of the object material is determined based on a current deviation and a previous deviation. By determining the amount of supply of the object material based on the current deviation and the previous deviation as described above, it becomes possible to supply the object material so as to bring the amount of the object material in the mill close to the desired amount more quickly, and prevent the amount of the object material in the mill from fluctuating wildly, making possible to obtain a uniform grain size distribution of the powder. Further, preferably, a first value corresponding to the weight of the object material remaining in the mill during the milling, and a second value corresponding to a weight greater than the weight of the object material corresponding to the first value are set, and supplying operation of the object material when the object material is supplied before a milling operation of the mill is controlled based on the output from the weight detector and the second value. In this case, the supply of the object material to the mill can be controlled based on the output from the weight detector not only during the milling operation but also during the time when the object material is supplied before the milling operation of the mill. Further, by making the amount of supply of the object material at the time before starting the milling operation of the mill greater than the weight of the object material remaining in the mill during the milling operation, it becomes possible to compensate in advance for a decrease in the amount of object material in the mill occurring immediately after starting the operation. Therefore, it becomes possible to obtain a uniform grain size distribution of the powder immediately after starting the milling operation of the mill and thereafter.

Further, by making the amount of supply of the object material at the time before starting the milling operation of the mill greater than the weight of the object material remaining in the mill during the milling operation, it becomes possible to compensate in advance for a decrease in the amount of object material in the mill occurring immediately after starting the operation. Therefore, it becomes possible to obtain a uniform grain size distribution of the powder immediately after staring the milling operation of the mill and thereafter.

Further, preferably, a third value corresponding to the weight of the object material remaining in the mill during the milling, and a fourth value corresponding to a weight smaller than the weight of the object material corresponding to the third value are set, and the milling operation of the mill is controlled based on the output from the weight detector and the fourth value. In this case not only during the milling operation of the mill but also in stopping the milling operation of the mill, the supply of the object material to the mill can be controlled based on the output from the weight detector. Further, by determining the stopping of the milling operation of the mill based on the weight of the object material remaining in the mill, it becomes possible to stop the milling operation before the weight of the object material remaining in the mill becomes not greater than the predetermined value. Therefore, it becomes possible to obtain a uniform grain size distribution of the powder at the time when the milling operation of the mill is being stopped.

Preferably, the object material is a rare-earth alloy. Such a rare-earth alloy as above is compacted after the milling for use as a magnet for example. If the milling is performed by the method described above, a uniform compact can be obtained due to the uniform grain size distribution.

According to another aspect of the present invention, there is provided a sintered body manufactured from a powder obtained by a milling method of milling an object material inside a mill, the method comprising steps of: detecting a weight of the mill holding the object material remaining therein; and controlling an amount of supply of the object material to the mill based on a result of the weight detection, for maintenance of a constant amount of the object material present in the mill.

By manufacturing a powder using the milling method described above, the powder having a uniform grain size distribution can be obtained, leading to an improved yield in a pressing step. Therefore, if a sintered body is manufactured from such a powder as above, yield of the sintered body can be improved.

The object described above, other objects, features, aspects and advantages of the present invention will become clearer from description of an embodiment to be made hereinafter with reference to the attached drawings.

DETAILED DESCRIPTION OF THE PREFERRED EMBODIMENTS

Hereinafter, an embodiment of the present invention will be described with reference to the drawings.

Figure 1:
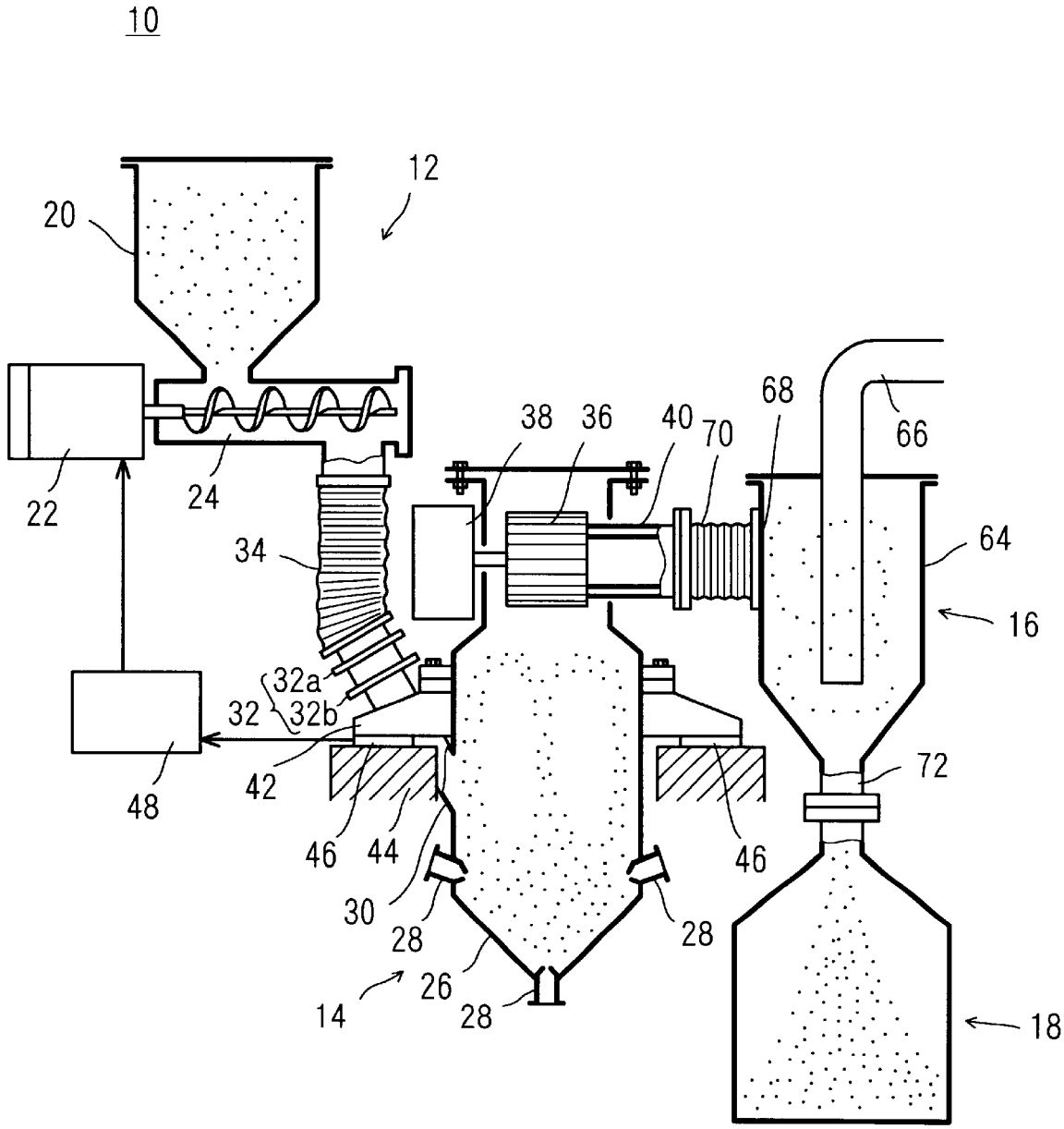
FIG. 1 is an overall constitution diagram showing a milling apparatus as an embodiment of the present invention.

Referring first to FIG. 1, the description will cover an overall constitution of a milling apparatus 10 as an embodiment of the present invention.

The milling apparatus 10 comprises a raw material feeder 12 for supply of an object material, a mill 14 for milling of the object material fed by the raw material feeder 12, a classifier 16 for classification of a powder obtained by the milling of the object material by the mill 14, and a collecting tank 18 for collection of the powder classified by the classifier 16 and having a predetermined grain size distribution.

The raw material feeder 12 includes a raw material tank 20 for storage of the object material, an electric motor 22 for controlling an amount of supply of the object material from the raw material tank 20, and a spiral-type supplier 24 connected to the electric motor 22.

The mill 14 includes a vertically elongate generally cylindrical mill main body 26. The mill main body 26 has a lower portion formed with a plurality of nozzle ports 28 for attachment of nozzles 88 (to be described later) for injection of a high-velocity blast of an inert gas. The mill main body 26 has a side portion formed with a raw material feeding pipe 30 for feeding the object material into the mill main body 26.

The raw material feeding pipe 30 is provided with a valve 32 for temporarily holding the object material to be supplied, and for holding an inside pressure of the mill 14. The valve 32 includes a pair of an upper valve 32*a* and a lower valve 32*b*. The supplier 24 and the raw material feeding pipe 30 are connected with each other by a flexible pipe 34.

The mill 14 further includes a classifying rotor 36 provided inside and at an upper portion of the mill main body 26, an electric motor 38 provided outside and an upper portion of the mill main body 26 for driving the classifying rotor 36, and a connecting pipe 40 provided at an upper portion of the mill main body 26 for discharging the powder classified by the classifying rotor 36. The mill 14 includes a plurality of leg portions 42 serving as supporting portions. A base 44 is provided closely around the mill 14. The mill 14 is placed on the base 44 via the leg portions 42, with a weight detector 46 such as a load cell disposed between the base 44 and each of the leg portions 42 of the mill 14.

The controlling portion 48 controls the number of revolutions of the electric motor 22 based on an output from each of the weight detectors 46, controlling an amount of feed of the object material.

Figure 2:
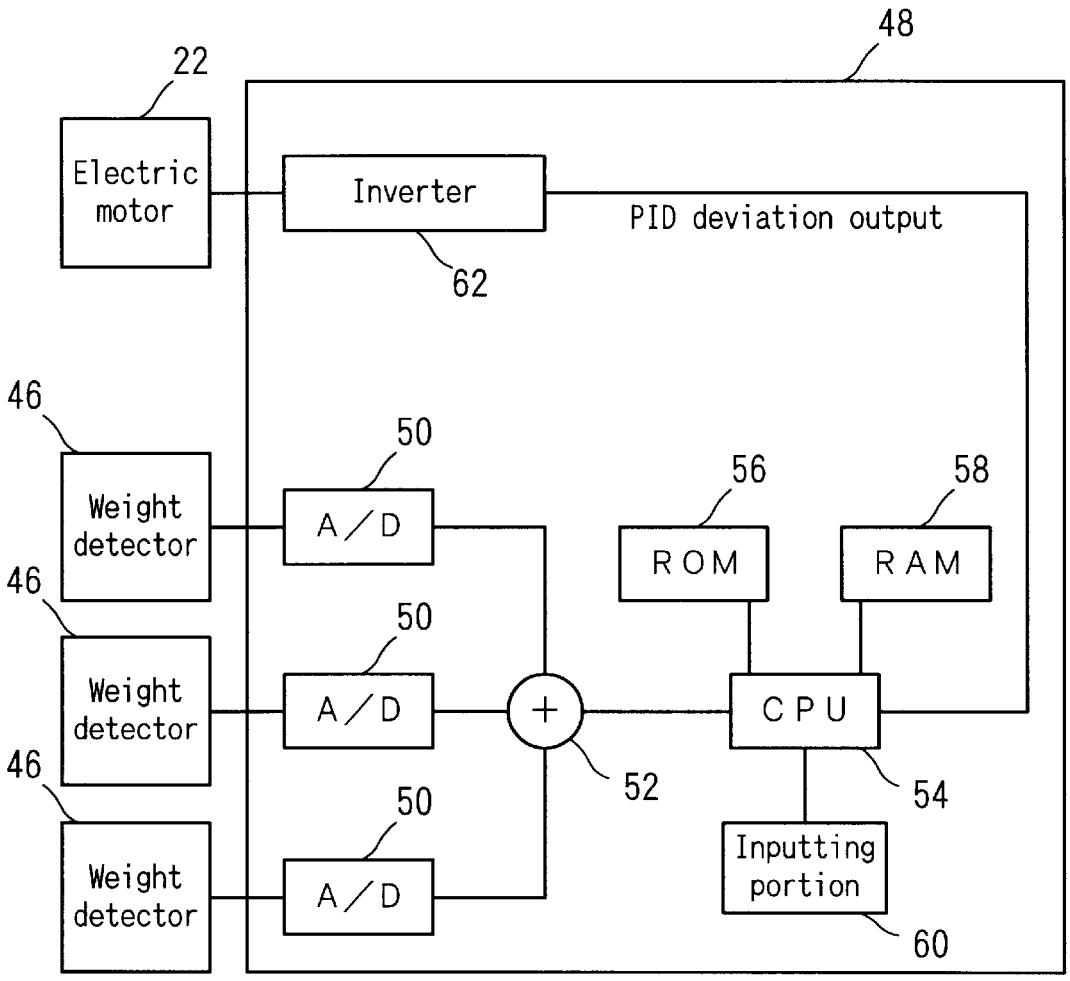
FIG. 2 is a block diagram showing a controlling portion used in the milling apparatus according to the present embodiment.

As shown in FIG. 2, the controlling portion 48 includes a plurality of A/D converters 50 for A/D conversion of the output from each of the three weight detectors 46. An output from each of the A/D converters 50 is summed by an adder 52 and fed as a weight data to a CPU 54. The CPU 54 is connected with a ROM 56 for storage of a program for control of operations of the raw material feeder 12 and data such as the weight data of the mill 14, a RAM 58 for storage of set values, calculation data and so on, and an inputting portion 60 such as a control panel for entry of a set value and so on. Based on the weight data, the CPU 54 calculates the weight of the object material remaining in the mill 14, performs a PID calculation for obtaining a proportional-plus-integral-plus-derivative deviation output, which is entered to an inverter 62 as an analog output. The inverter 62 converts the analog output to the number of revolutions, which is then used for controlling the electric motor 22. It should be noted here that set values may be stored in advance in the ROM 56.

Referring back to FIG. 1, the classifier 16 includes a classifier main body 64. The classifier main body 64 is inserted by a gas exhausting pipe 66 from above. The classifier main body 64 has a side portion provided with an intake port 68 for introduction of the powder classified by the classifying rotor 36. The intake port 68 is connected to the connecting pipe 40 by a flexible pipe 70. The classifier main body 64 has a lower portion provided with a discharge port 72. The discharge port 72 is connected to the collecting tank 18.

According to the milling apparatus 10 arranged as described above, the mill 14 is connected with the raw material tank 20 of the raw material feeder 12, the electric motor 22 and the supplier 24 via a flexible pipe 34. Further, the mill 14 and the classifier 16 are connected via a flexible pipe 70. Therefore, the leg portions 42 of the mill 14 bear the weight not only of the mill main body 26 but also of the raw material feeding pipe 30, the connecting pipe 40, the classifying rotor 36, the electric motor 38, and a weight of the object material remaining in the mill 14. It should be noted here that the flexible pipes 34 and 70 may be made of such a material as a resin, a rubber, or a flexible structure such as a coil or bellows made of a rigid material, as long as the pipe allows interconnected members to easily displace in accordance with a change in a weight load applied, thereby allowing the member at one end not to be much subjected to the change in the weight load applied to the member connected to the other end.

As understood from the above, the use of the flexible pipes 34 and 70 virtually makes free the leg portions 42 of the mill 14 from weight changes in the object material tank 20, the supplier 24, the classifier main body 64 and the collecting tank 18 each varying depending upon the amount of the object material present therein. Therefore, the weight detection by the weight detectors 46 provided in the leg portions 42 allows an accurate detection of the weight as well as change in the weight of the object material remaining in the mill 14, making possible to accurately control the amount of the object material supplied into the mill 14.

As in the above embodiment, by providing the flexible pipe 34 closer to the supplier 24 than is the valve 32, the powder in the mill 14 is prevented from hitting the flexible pipe 34, thus the flexible pipe 34 is not worn by the powder. Therefore, it becomes no longer necessary to pay strict consideration to abrasion resistance or durability against collision by the powder. Thus, a choice of material and constitution of the flexible pipe 34 becomes less restrictive. Further, even if the inside pressure of the mill 14 is reduced or increased during the milling, or inert gas is used, since it is no longer necessary to pay strict consideration to abrasion resistance or durability, there is less restriction to the choice of material and constitution of the flexible pipe 34. The flexible pipe 34 may be provided closer to the mill 14 than is the valve 32. With this arrangement, it becomes possible to make the weight detectors 46 not affected by the weight of the valve 32, making possible to detect the weight change of the object material more accurately.

Figure 3:
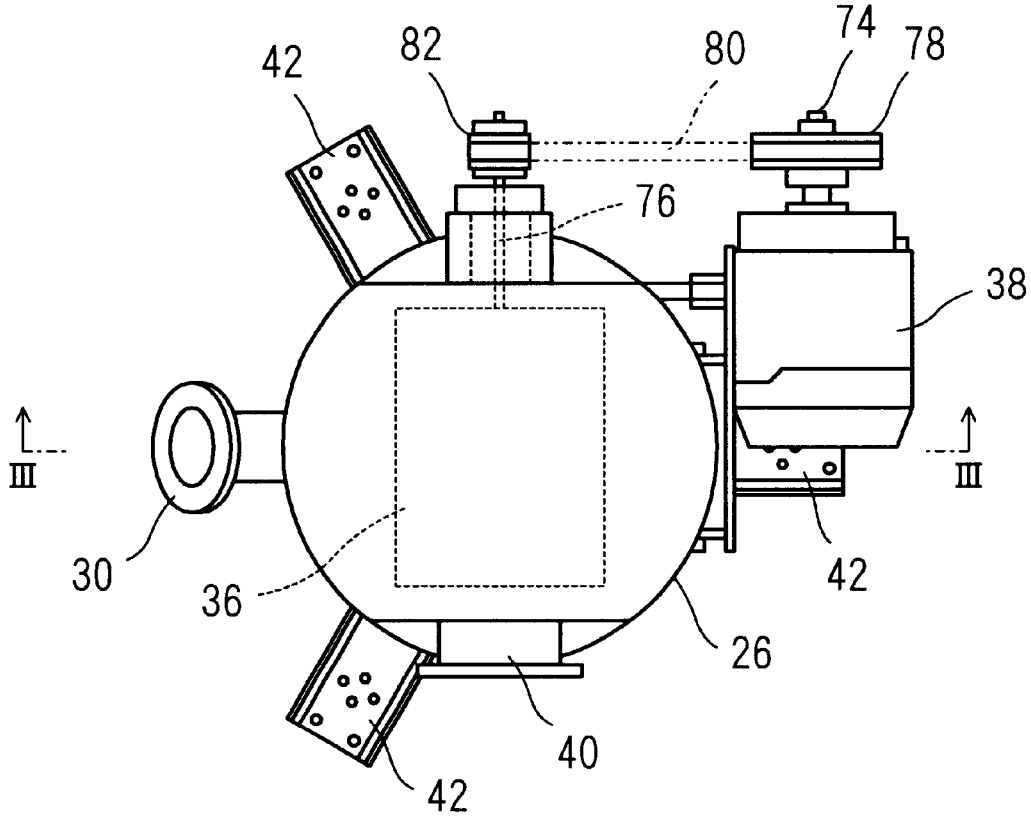
FIG. 3 is a plan view showing a primary constitution of a mill used in the milling apparatus according to the present embodiment.

Next, disposition of main components of the mill 14 will be described with reference to FIG. 3 and FIG. 4.

The electric motor 38 which drives the classifying rotor 36 has a drive shaft 74 not co-axially connected to a rotating shaft 76 of the classifying rotor 36. The rotating shaft 76 is driven by the electric motor 38 via a pulley 78, a belt 80 and a pulley 82. With such an arrangement as this, it becomes possible to dispose the electric motor 38 along a side portion of the mill main body 26. Specifically, in this case, it becomes possible to reduce an angular moment caused in the mill main body 26 by the weight of the electric motor 38 as compared to the case in which the drive shaft 74 is directly connected with the rotating shaft 76 of the classifying rotor 36.

Further, the raw material feeding pipe 30 is provided on a side portion of the mill main body 26 away from the side portion disposed with the electric motor 38.

Further, the mill main body 26 has a lower portion provided with a dumping lid 84 for maintenance purposes such as removal of the remaining powder from inside of the mill 14. The dumping lid 84 has a hinge 86 disposed on a side portion of the mill main body 26 away from the side portion provided with the electric motor 38.

Therefore, it becomes possible to offset an angular moment generated by the electric motor 38 in the mill main body 26, by an angular moment generated by the raw material feeding pipe 30 in the mill main body 26 and an angular moment generated by the hinge 86 in the mill main body 26, making possible to prevent the mill main body 26 from tilting, thereby keeping the center of gravity of the mill 14 at a center portion of the mill 14. As a result, load distribution to the leg portions 42 can be uniform, making possible to increase accuracy in the weight detection by the weight detectors 46.

It should be noted here that the side portion of the mill main body 26 disposed with the electric motor 38 and said other side portion away therefrom may not necessarily have respective load bearing points in a single axis which passes the center of gravity of the mill 14. More specifically, the raw material feeding pipe 30 should at least be disposed at such a position that more than half of the angular moment generated by the raw material feeding pipe 30 is offset by the angular moment generated by the electric motor 38. Likewise, the hinge 86 should at least be disposed at such a position that more than half of the angular moment generated by the hinge portion 86 is offset by the angular moment generated by the electric motor 38.

It should be noted further, that according to the present embodiment the dumping lid 84 is disposed in the lower portion of the mill main body 26. However, the dumping lid 84 may be disposed on a side portion of the mill main body 26 away from the side portion provided with the electric motor 38, in accordance with the condition described above.

Further, the pulleys 78, 82 and the belt 80 may be replaced by other transmission members such as gears.

Next, the leg portions 42 will be described. As will be clearly understood from FIG. 3, the three leg portions 42 are disposed at a same interval from each other on an outer circumference of the mill main body 26. The weight detector 46 is provided in a lower surface of each of the three leg portions 42, and therefore disposed at three equidistant locations on the circumference. With such an arrangement as this, in which the mill main body 26 is supported by three leg portions 42 each provided with the weight detector 46 so that the output from each weight detector 46 is summed up, detection accuracy by the weight detectors 46 can be increased even if the mill 14 is tilted or the weight distributes unevenly to the three weight detectors 46. Therefore, it becomes possible to accurately supply the object material. Especially, the use of the three leg portions 42 as the supporting portions eliminate gap between each of the leg portions 42 and the base 44, making possible to support the mill 14 stably without chattering and detect more accurately the weight of the mill 14 holding the remaining object material. It should be noted here that according to the present embodiment three leg portions are provided, but a greater number of leg portions may be provided.

Figure 4:
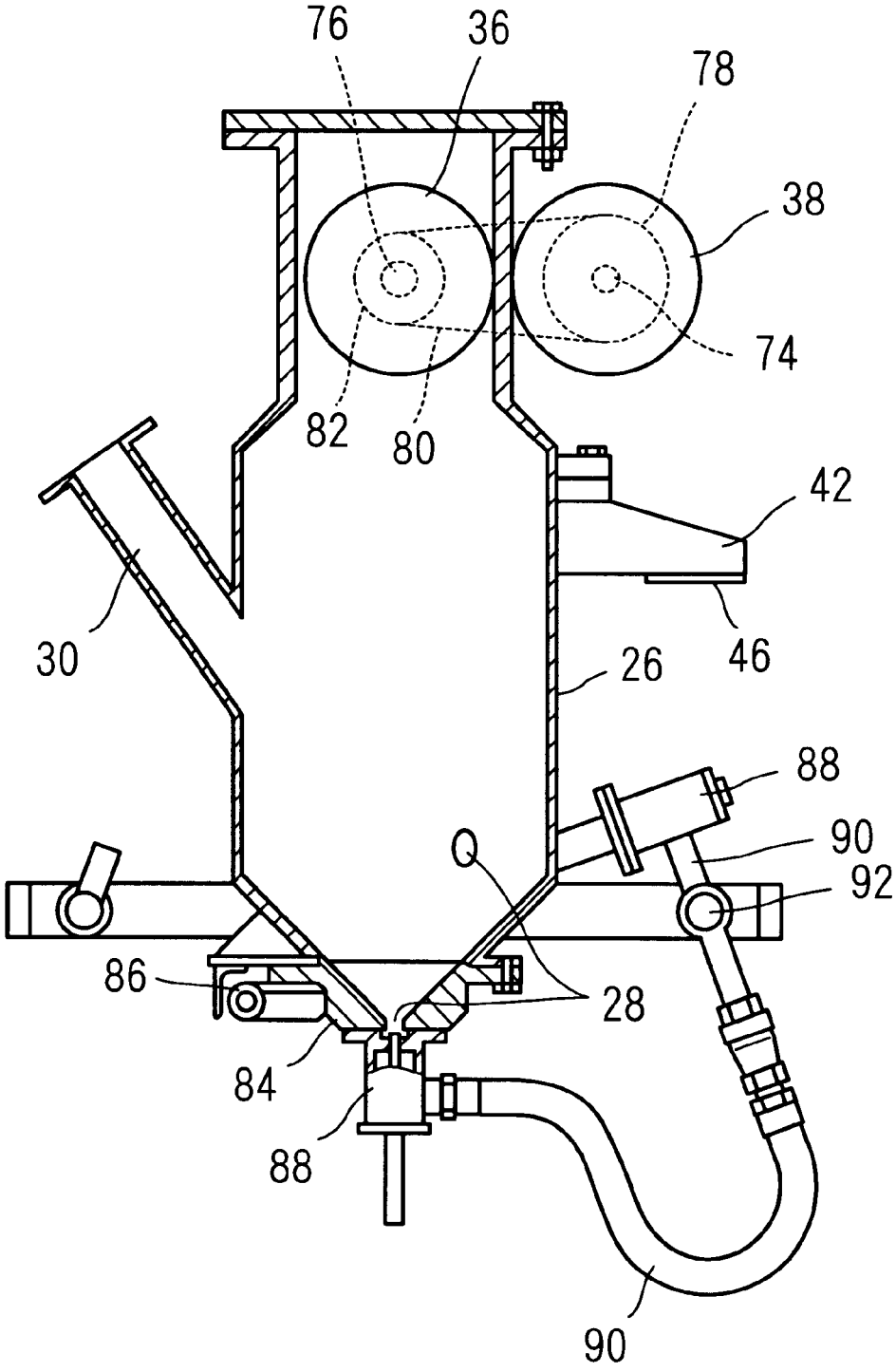
FIG. 4 is a sectional view taken in line III—III in FIG. 3.

As shown in FIG. 4, each of the leg portions 42 is provided on a side portion of the mill main body 26 above the position where the raw material feeding pipe 30 is connected. By disposing the leg portions 42 above the position where the raw material feeding pipes 30 are connected as described above, a weight from the raw material feeder 12 can be added to a lower portion of the mill main body 26, making lower the center of gravity of the mill 14. Therefore, tilting of the mill 14 caused by the weight of the mill 14 can be reduced, making possible to support the mill 14 stably and detect the weight of the mill 14 accurately. In order to reduce the tilting of the mill 14 caused by the weight of the mill 14 and so on, the leg portions 42 should preferably be provided at a level higher than the center of gravity of the mill 14. This arrangement is particularly effective if the classifying rotor 36 is positioned at an upper location inside the mill main body 26. Further, it is also effective to position each of the leg portions 42 between two large weight loads, i.e. between the electric motor 38 and the place where the raw material feeding pipe 30 is connected.

Further, by disposing each of the leg portions 42 on the base 44 closely surrounding the circumference of the mill main body 26, it becomes possible to reserve enough distance from positions on the base 44 where the leg portions 42 are footed to the mill main body 26. Therefore, supporting stability of the mill main body 26 can be increased, making possible to improve accuracy in the detection by the weight detectors 46.

Further, as shown in FIG. 4 each of the nozzle ports 28 is provided with a nozzle 88. Each nozzle 88 is connected via a flexible pipe 90 to a pipe 92 which supplies the inert gas.

Now, a method for milling by using the milling apparatus described as above will be outlined with reference to FIG. 1.

First, the object material is loaded into the raw material tank 20. The object material in the raw material tank 20 is supplied by the supplier 24. At this time, the amount of supply can be varied by controlling the number of revolutions of the electric motor 22. The object material supplied from the supplier 24 is stopped temporarily at the valve 32, where the pair of the upper valve 32*a* and the lower valve 32*b* open and close in an alternating manner. Specifically, the lower valve 32*b* closes when the upper valve 32*a* is open whereas the lower valve 32*b* opens when the upper valve 32*a* is closed. By opening and closing the pair of valves 32*a* and 32*b* in the alternating manner as above, a pressure inside the mill 14 is prevented from escaping toward the raw material feeder 12. Therefore, the object material is supplied between the pair of upper valve 32*a* and lower valve 32*b* when the upper valve 32*a* is opened, and then introduced into the raw material feeding pipes 30 for feeding into the mill 14 when the lower valve 32*b* is opened next. These valves 32*a,* 32*b* are operated at a high frequency by a sequence circuit (not illustrated) separate from the controlling portion 48 so that the object material is supplied continuously into the mill 14.

The object material introduced into the mill 14 sediments in a lower portion of the mill 14, and is blown up within the mill 14 by the blast of inert gas from the nozzle ports 28, and milled by mutual collision of the object material.

The powder resulting from the milling of the object material as described above, is then brought into the classifying rotor 36 by an upward current, and classified by the classifying rotor 36 so that big grains are milled again.

On the other hand, small grains milled to a size not greater than a predetermined grain diameter are introduced into the classifier main body 64 via the connecting pipe 40, the flexible pipe 70, and the intake port 68, and then sediment in the collecting tank 18 disposed below. It should be noted here that grains milled into too small a size are discharged from the exhaust pipe 66.

Figure 5:
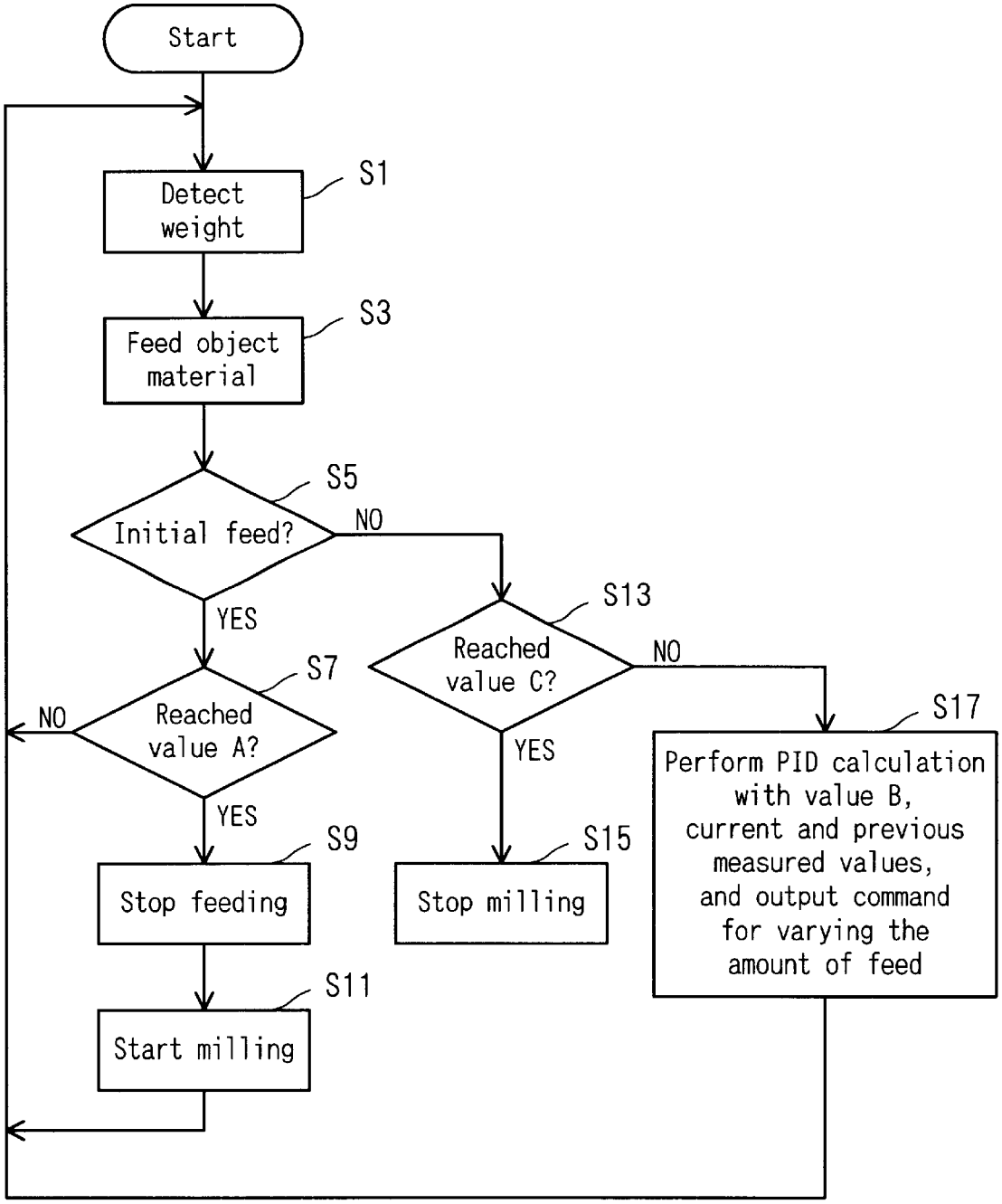
FIG. 5 is a flowchart showing an example of a primary operation of the milling apparatus according to the present embodiment.

Next, a method of controlling at the controlling portion 48 is described with reference to FIG. 5.

First, three set values are stored in advance in the ROM 56 or the RAM 58 of the controlling portion 48. One of the set values, or value A, represents an amount of initial feed, another of the values, or value B, represents a target value during the milling, and the other, or value C, represents a value for stopping the operation of the mill 14. The value B corresponds to the first value and the third value in the claims. The value A is greater than the value B whereas the value C is smaller than the value B. It should be noted here that a plurality of deviation ranges on the basis of the value B are set in advance, too. The controlling portion 48 periodically checks the data from the weight detectors 46. According to the present embodiment, the weight of the object material remaining in the mill 14 is calculated based on a total value of the three weight values. Hereinafter, the term "measured value" means the weight of the object material remaining in the mill 14.

The initial feeding of the object material into the mill 14 is continued until the measured value reaches the set value A. As long as step S5 determines that the feeding is the initial feeding, step S1 for weight detection of the mill 14 and step S3 for feeding the object material are repeated until step S7 determines the measured value has reached the set value A. When the step S7 detects that the measured value has reached the set value A, step S9 is executed to stop the feeding of the object material, and then the milling of the object material is commenced in step S11. During the milling, the blast of high-velocity inert gas is injected from the nozzles 88 and the classifying rotor 36 is rotated.

Timing for stopping the milling is determined (in step S13) by checking whether the measured value has reached the set value C. If the step S5 determines the present feeding is not the initial feeding, the step 13 is executed to see if the measured value has reached the set value C. If the set value C has been reached, then step S15 is executed to stop the milling. As described above, detection that the measured value has reached the set value C draws the determination that there is no longer the object material to be fed. In this arrangement, the set value C should not be set to zero, i.e. the value representing the state that there is no object material in the mill 14, but should preferably be set to a weight value representing a state in which the amount of the object material has decreased to a level where a predetermined grain size distribution can no longer be obtained for the powder even though there is the object material still remaining in the mill 14. In other words the set value C is preferably slightly smaller than the set value B as described in the embodiment from which results shown in FIG.6 were obtained. If the same raw material is to be milled in the next cycle, a new feeding of the raw material is performed by adding to the remaining object material while an atmosphere in the mill 14 is maintained, and then the milling operation is started again. If another kind of raw material is milled in the next cycle, then the remaining object material is removed.

During a normal milling operation, a PID calculation is performed in step S17 using the set value B, a current measured value, and a previous measured value, and then a command for varying the amount of feed is outputted. In this PID calculation, comparison is made between the deviation of the current measured value from the set value and the deviation of the previous measured value from the set value. The amount of feeding is determined based on the direction and size of a deviation between the two deviations.

As described above, the amount of feed of the object material is controlled based on the weight detection.

According to the milling apparatus 10, the weight of the object material remaining in the mill 14 is detected by detecting the weight of the mill 14 holding the remaining object material. Thus, change in the weight of the object material remaining in the mill 14 can be detected without time delay. Therefore, as compared with a method, for example, of measuring the weight of the collecting tank 18 which collects the powder discharged from the mill 14, the amount of feed of the object material into the mill 14 can be varied more appropriately without time delay. As a result, it becomes possible to eliminate hunting caused by overfeeding, and maintain the amount of the object material in the mill 14 at a constant level. Further, by detecting the weight, the weight deviation from the target value can be detected. Therefore, the amount of supply can be varied in accordance with the deviation, making possible to bring the amount of the object material in the mill 14 close to the desired amount more quickly. As a result, the powder having a uniform grain size distribution can be obtained.

Further, by controlling the amount of supply of the object material based on the proportional-plus-integral-plus-derivative control, the amount of the object material in the mill 14 can be brought closer to the desired value, making possible to reduce fluctuation. Therefore, the grain diameter of the powder can be maintained within a constant range.

Further, by determining the amount of feed of the object material based on the current deviation and the previous deviation, it becomes possible to supply the object material in such a way that the amount of the object material in the mill 14 quickly approaches the desired value, while preventing a wild fluctuation of the amount of the object material in the mill 14, making possible to obtain a uniform grain size distribution of the powder.

Further, not only during the milling operation of the mill 14 but also in supplying the object material before starting the milling operation of the mill 14, the supply of the object material to the mill 14 can be controlled based on the output from the weight detectors 46. Further, by setting the amount of supply of the object material before starting the milling operation of the mill 14 to a value greater than the weight of the object material remaining in the mill 14 during the milling operation, it becomes possible to compensate in advance for a decrease in the amount of object material in the mill 14 occurring immediately after starting the operation. Therefore, it becomes possible to obtain a uniform grain size distribution of the powder immediately after starting the milling operation of the mill 14 and thereafter.

Further, not only during the milling operation of the mill 14 but also in stopping the milling operation of the mill 14, the supply of the object material to the mill 14 can be controlled based on the output from the weight detectors 46. Further, by determining the stopping of the milling operation of the mill 14 based on the weight of the object material remaining in the mill 14, it becomes possible to stop the milling operation before the weight of the object material remaining in the mill 14 becomes not greater than the predetermined value. Therefore, it becomes possible to obtain a uniform grain size distribution of the powder at the time when the milling operation of the mill 14 is being stopped.

Next, description will cover the change in the amount of the remaining object material and variation in the grain size among a plurality of lots.

Results shown in FIG. 6 through FIG. 9 were obtained under a following milling condition:

Milling was performed in a comparative example by using a method of on/off control, in which a minimum remaining amount was set to 31 kg and a maximum remaining amount was set to 34 kg. On the other hand, milling was performed in the present embodiment by using a PID control, in which the initial amount of feed was set to 40 kg, the remaining amount during the milling was set to 32.5 kg, and the amount for stopping the milling was set to 31 kg. It should be noted here that in both of the comparative example and the present embodiment, the milling pressure was 0.49 MPa, the classifying rotor was driven at 2,000 rpm, with an average input amount of the raw material being 50 kg/h.

Further, a rare-earth alloy powder was used as the object material. After milling the rare-earth alloy powder may then be compacted and made into a magnet etc.

The rare-earth alloy powder was prepared as follows.

Specifically, first, an ingot was made by using a following strip casting process as disclosed in U.S. Pat. No. 5,383,978.

More specifically, an alloy having a composition comprising 30(% by weight) Nd, 1.0 B, 1.2 Dy, 0.2 Al, 0.9 Co with the rest including Fe and unavoidable impurities was melted by a high-frequency melting process into a molten. The molten was maintained at 1,350° C., and then quenched on a single roll under a cooling condition of a roll peripheral speed of about 1 m/s, a cooling rate of 500° C./sec, and a sub-cooling of 200° C., yielding a mass of flaky alloy having a thickness of about 0.3 mm and a diameter ranging from 1 mm~10 mm.

The obtained flaky alloy was allowed to absorb hydrogen for embrittlement, and then coarsely milled into grains having an average diameter not greater than 1 mm. Then further milling was performed by a jet mill in a nitrogen gas atmosphere to obtain a fine powder of the rare-earth alloy.

Figure 6:
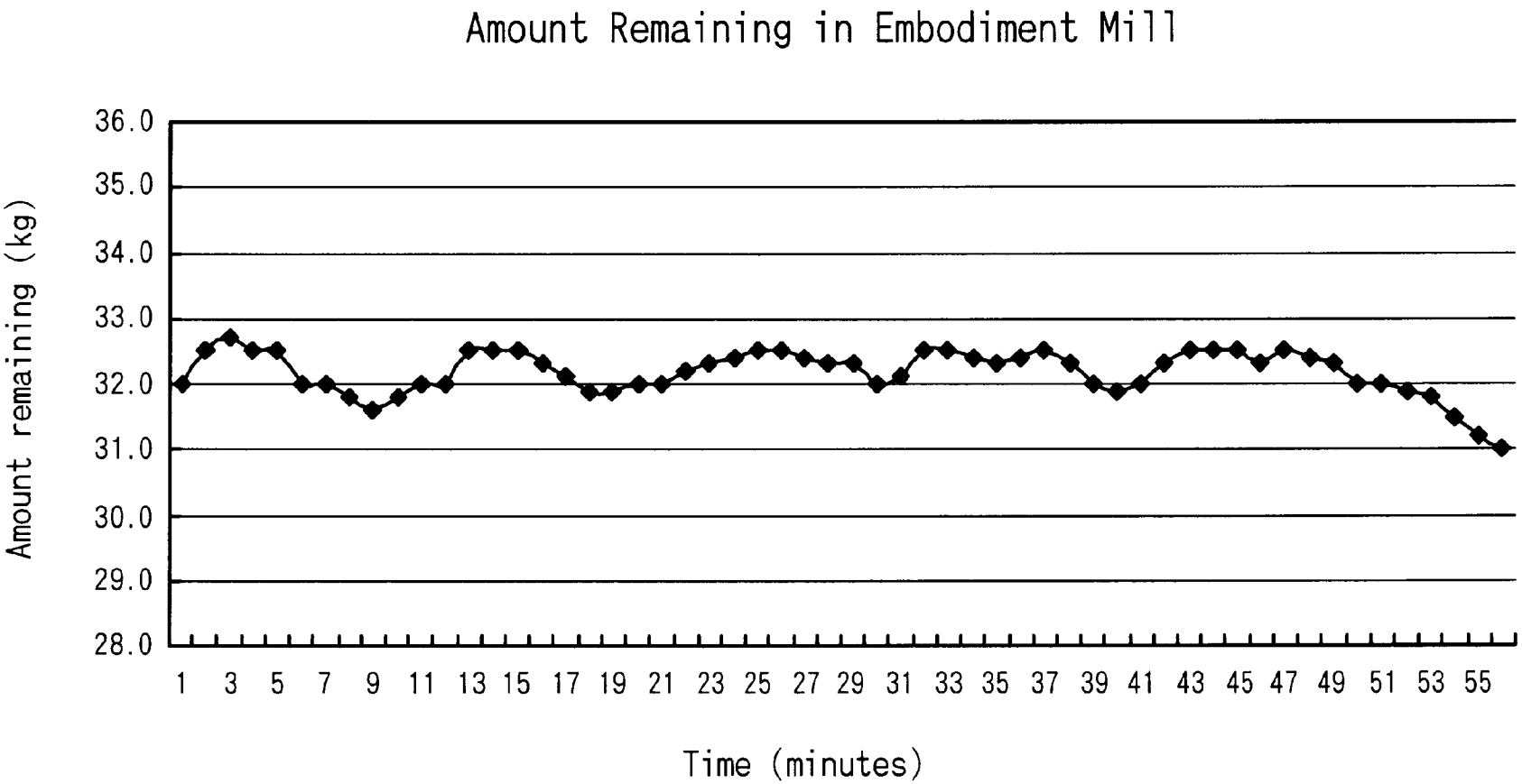
FIG. 6 is a graph showing an amount of an object material remaining in the mill of the milling apparatus according to the present embodiment.
Figure 7:
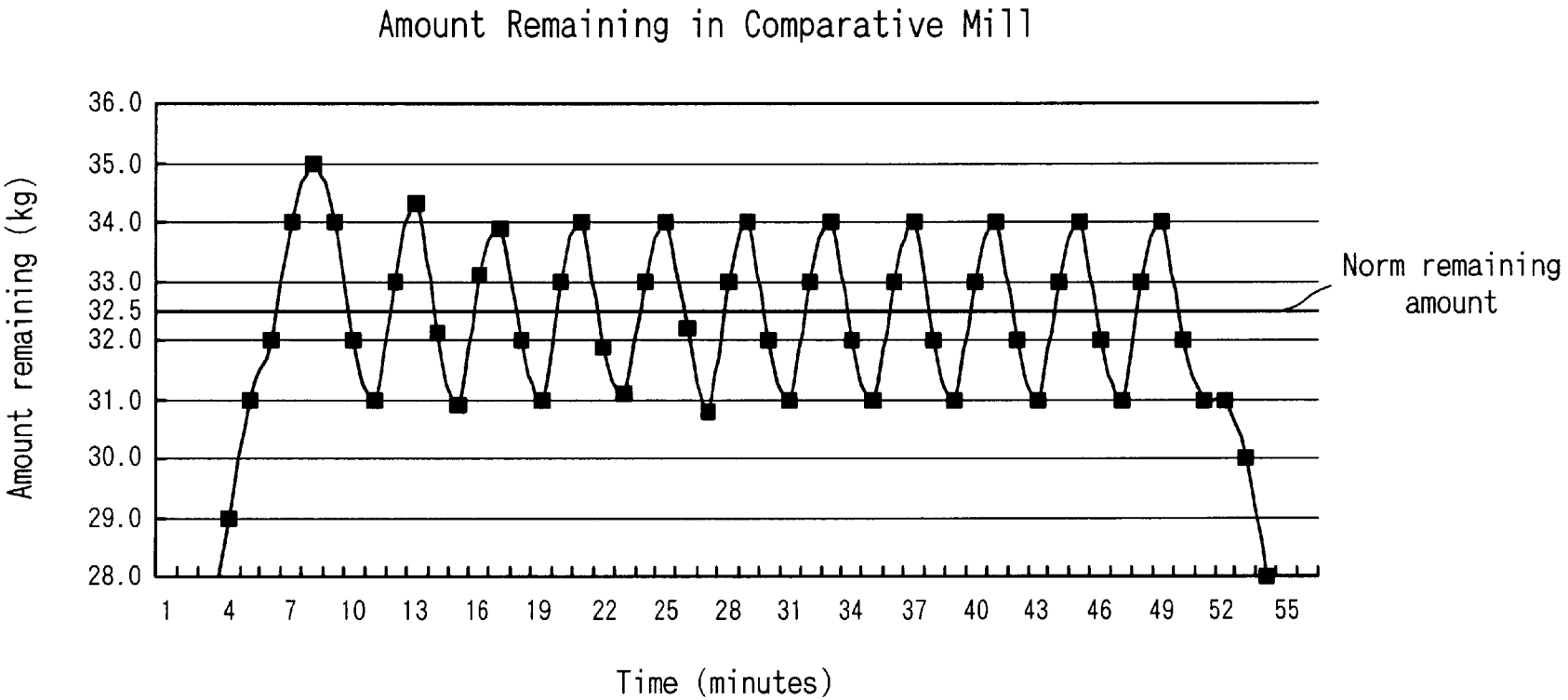
FIG. 7 is a graph showing an amount of the object material remaining in a mill of a milling apparatus as a comparative example.

FIG. 6 shows the amount of the rare-earth alloy powder remaining in the mill 14 of the milling apparatus 10 of the present embodiment. FIG. 7 shows a comparative example, in which the weight detector 46 was provided to the mill 14, and the mill 14 was controlled by on/off method and operated from a time when feeding of the powder was started to a time when the powder was no longer present in the mill 14. Other conditions were the same. It should be noted that in FIG. 6 and FIG. 7, the horizontal axis represents the time passed whereas the vertical axis represents the amount of rare-earth alloy powder remaining in the mill 14.

According to the comparative example, as shown in FIG. 7, the initial feeding was made far above the predetermined amount. Further, even after the remaining powder reached the predetermined amount, the remaining amount kept fluctuating wildly above and below a norm remaining amount (32.5 kg according to the present embodiment). On the other hand, as shown in FIG. 6, according to the present embodiment, not only in the initial phase of the operation, but also throughout the operation, the range of fluctuation in the remaining amount was narrowed.

Figure 8:
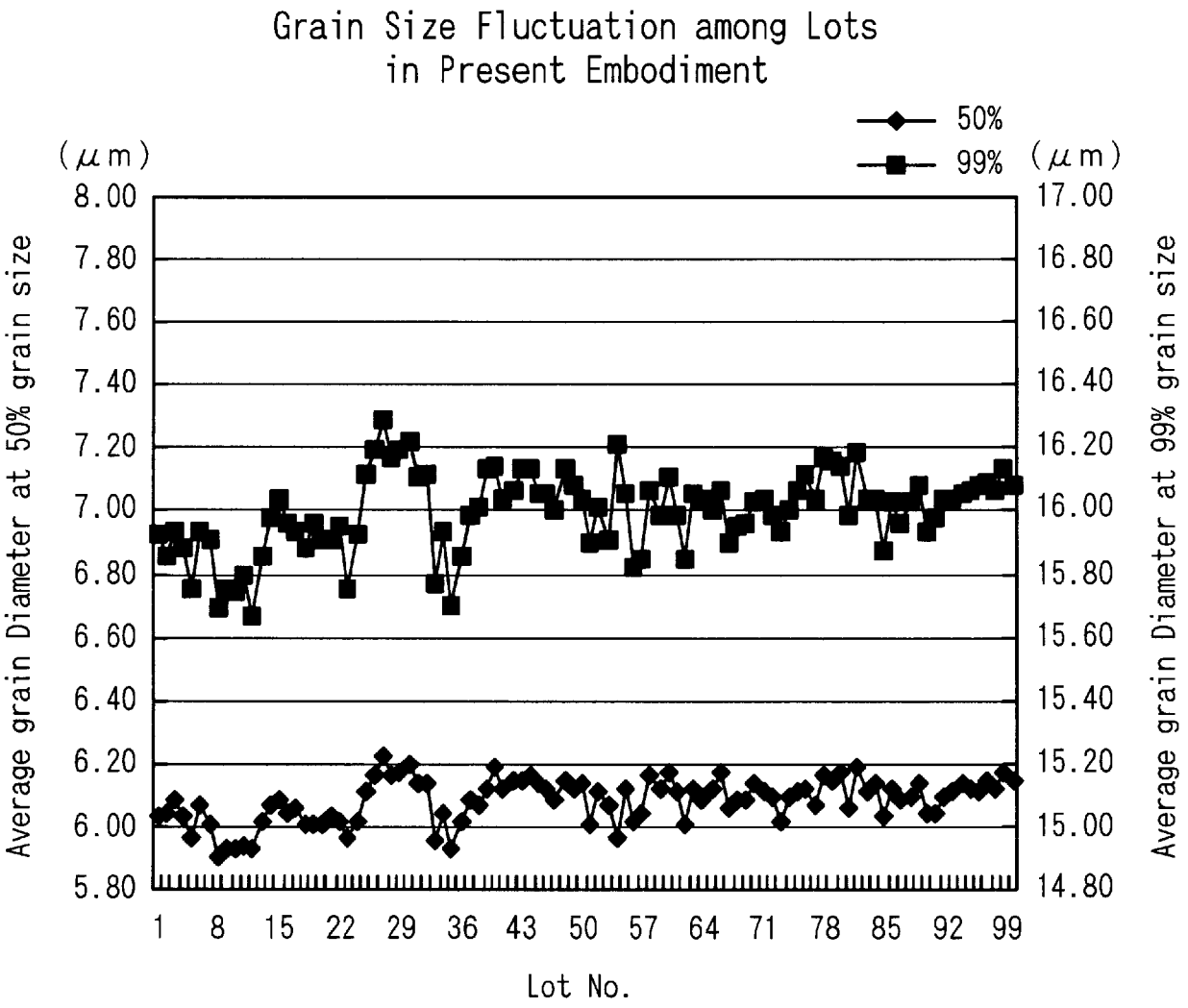
FIG. 8 is a graph showing a fluctuation in grain size in a plurality of lots produced by the present embodiment.
Figure 9:
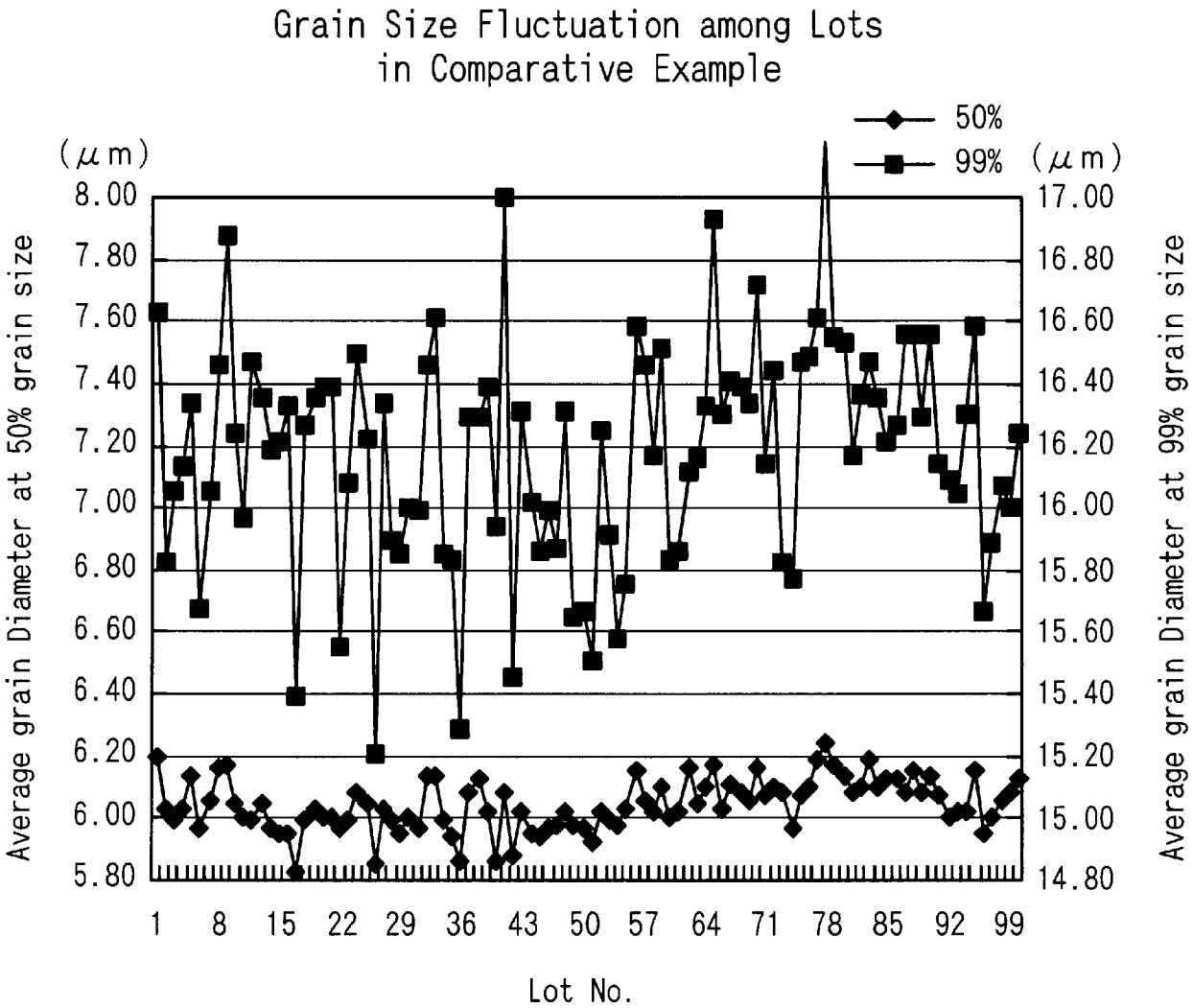
FIG. 9 is a graph showing the fluctuation in the grain size in a plurality of lots produced by the comparative example.
Figure 10:
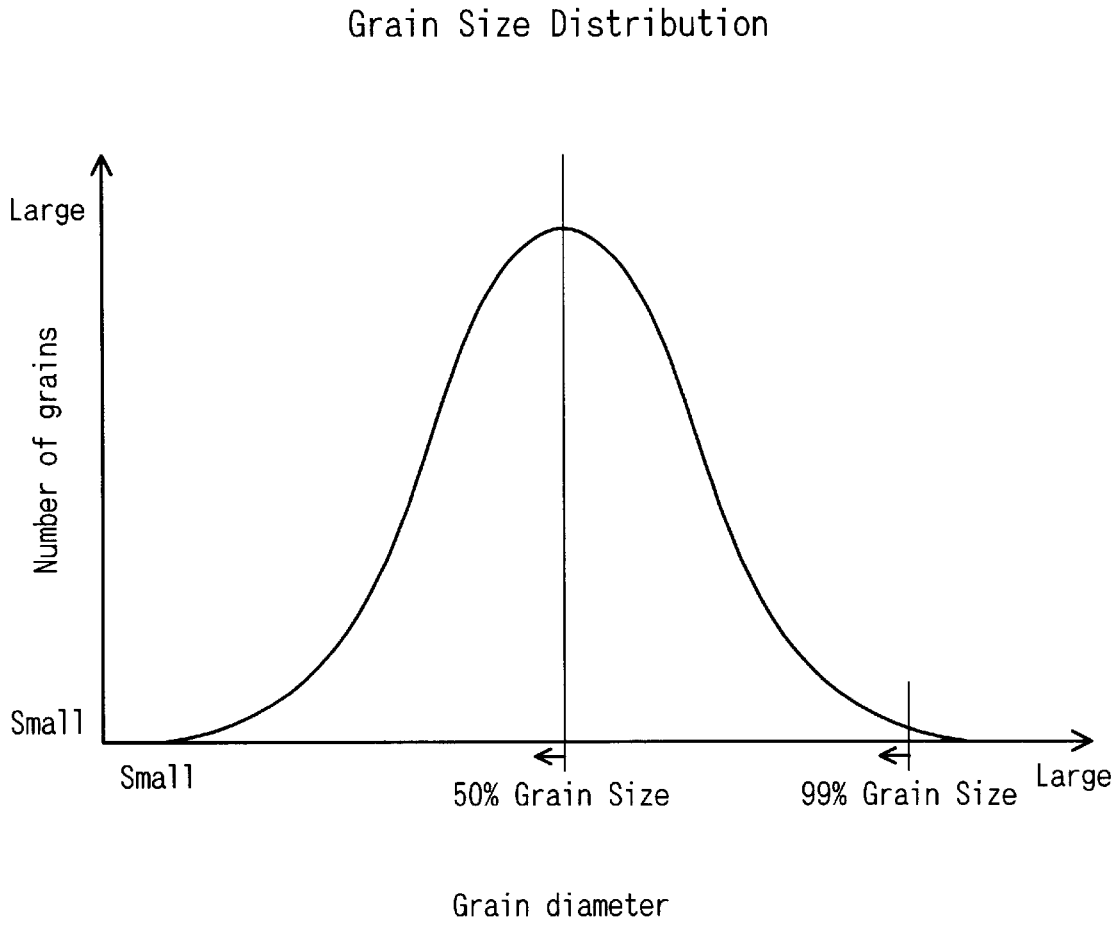
FIG. 10 is a diagram showing an example of a grain size distribution.

FIG. 8 is a graph showing a fluctuation in the grain size in a plurality of lots produced by the present embodiment. FIG. 9 is a graph showing a fluctuation in the grain size in a plurality of lots produced by the apparatus used experiment in FIG. 7. In each of FIG. 8 and FIG. 9, the graph shows a fluctuation of "50% grain size" and a fluctuation of "99% grain size" in an accumulated grain size distribution among the lots. In each of the present embodiment and the comparative example, a total of 100 lots were sampled. In this embodiment, these grain sizes were measured by a measurement equipment (HELOS type) using laser diffraction method sold from Japan Laser Corporation. FIG. 10 shows an example of the grain size distribution.

As will be clearly understood from FIG. 8 and FIG. 9, the fluctuation in the grain size among the lots is smaller in the present embodiment than in the comparative example. Especially, the grain size fluctuation in the 99% grain size is small. Therefore, the grain size distribution of the powder in the present embodiment is more uniform than in the comparative example.

As has been described above, according to the present embodiment, the rare-earth alloy having a uniform grain size distribution can be obtained. Thus, it becomes possible to reduce fracture in a pressing step, thereby obtaining a uniform compact.

As described above, since the powder has a uniform grain size distribution and yield in the pressing step can be improved, if such a powder is used in manufacturing a sintered body, yield of the sintered body can be improved.

The sintered body can be manufactured from the powder by first orienting the powder in a magnetic field of 0.8 MA/m, pressing the powder under a pressure of 14.7 MPa into a compact. The obtained compact is sintered for about one hour at 1000° C. ~1200° C. in an argon gas atmosphere, and then cooled to obtain the sintered body.

It should be noted here that the set value A, B and C may include the weight of the mill 14 and the feeding of the object material may be controlled accordingly.

Further, the electric motor 38 may be disposed along an upper portion of the mill main body 26.

The present invention being thus far described and illustrated in detail, it is obvious that these description and drawings only represent an example of the present invention, and should not be interpreted as limiting the invention. The spirit and scope of the present invention is only limited by words used in the accompanied claims.

What is claimed is:

1. A milling apparatus comprising:

a mill for milling of an object material, a raw material feeder for supply of the object material to the mill, a collecting tank for collection of a powder obtained by the mill, a weight detector for detection of a weight of the mill holding the object material remaining therein, and a controlling portion for control of an amount of supply of the object material to the mill based on an output from the weight detector, for maintenance of a constant amount of the object material present in the mill, wherein the mill includes a mill main body, and three supporting portions provided at an equidistant interval on a circumference of the mill main body, each of the supporting portions being provided with the weight detector.

2. A milling apparatus comprising:

a mill for milling of an object material, a raw material feeder for supply of the object material to the mill, a collecting tank for collection of a powder obtained by the mill, a weight detector for detection of a weight of the mill holding the object material remaining therein, and a controlling portion for control of an amount of supply of the object material to the mill based on an output from the weight detector, for maintenance of a constant amount of the object material present in the mill, wherein the mill includes a mill main body included in the object of weight detection, and a supporting portion for support of the mill main body at a position above the center of gravity of the mill.

3. A milling apparatus comprising:

a mill for milling of an object material, a raw material feeder for supply of the object material to the mill, a collecting tank for collection of a powder obtained by the mill, a weight detector for detection of a weight of the mill holding the object material remaining therein, a controlling portion for control of an amount of supply of the object material to the mill based on an output from the weight detector, for maintenance of a constant amount of the object material present in the mill, a flexible pipe provided between the raw material feeder and the mill, and another flexible pipe provided between the mill and the collecting tank.

4. A milling method using a mill milling a supplied object material and discharging an obtained powder out of the mill, comprising:

a first step of setting a value corresponding to a target weight of the object material remaining in the mill during the milling, a second step of detecting a weight of the mill holding the object material remaining therein, and a third step of calculating a deviation based on a result of the detection in the second step and said value, and controlling an amount of supply of the object material to the mill based on a current deviation and a previous deviation, for maintenance of a constant amount of the object material present in the mill.

5. A milling method using a mill milling a supplied object material and discharging an obtained powder out of the mill, comprising:

a first step of setting a first value corresponding to a target weight of the object material remaining in the mill during the milling, and a second value corresponding to a weight greater than the target weight corresponding to the first value, a second step of detecting a value corresponding to a weight of the object material remaining in the mill, and a third step of controlling the supplying operation of the object material to the mill based on results of the detection in the second step, the second value and a detection of a deviation therebetween when the object material is supplied before a milling operation of the mill.

6. A milling method using a mill milling a supplied object material and discharging an obtained powder out of the mill, comprising:

a first step of setting a first value corresponding to a target weight of the object material remaining in the mill during the milling, and a second value corresponding to a weight smaller than the target weight corresponding to the first value, a second step of detecting a value corresponding to a weight of the object material remaining in the mill, and a third step of controlling the stopping operation of the mill based on results of the detection in the second step, the second value and a detection of a deviation therebetween.

7. The method according to one of claims 4 to 6, wherein the object material is a rare-earth alloy.

* * * * *